US010697227B2

(12) United States Patent
Lehner, Jr. et al.

(10) Patent No.: US 10,697,227 B2
(45) Date of Patent: Jun. 30, 2020

(54) KEYED REMOVABLE MULLION

(71) Applicant: Schlage Lock Company LLC, Carmel, IN (US)

(72) Inventors: Jack R. Lehner, Jr., Indianapolis, IN (US); Matthew A. Phillips, Greenfield, IN (US)

(73) Assignee: Schlage Lock Company LLC, Carmel, IN (US)

( * ) Notice: Subject to any disclaimer, the term of this patent is extended or adjusted under 35 U.S.C. 154(b) by 189 days.

(21) Appl. No.: 16/000,063

(22) Filed: Jun. 5, 2018

(65) Prior Publication Data

US 2019/0368261 A1 Dec. 5, 2019

(51) Int. Cl.

| | |
|---|---|
| ***E06B 5/00*** | (2006.01) |
| ***E06B 1/52*** | (2006.01) |
| ***E05B 65/06*** | (2006.01) |
| ***E06B 3/96*** | (2006.01) |

(52) U.S. Cl.

CPC ..... *E06B 1/524* (2013.01); *E05B 65/06* (2013.01); *E06B 3/9632* (2013.01)

(58) Field of Classification Search

CPC ..... E06B 1/524; E06B 1/526; E06B 3/362; E05B 65/06

USPC ..... 49/365

See application file for complete search history.

(56) References Cited

U.S. PATENT DOCUMENTS 5,435,102 A 7/1995 McCarthy
5,450,697 A 9/1995 Prucinsky et al.
5,471,792 A 12/1995 Higgins et al.
5,794,382 A 8/1998 Prucinsky
6,427,387 B1 * 8/2002 Hunt ..... E06B 1/524 292/219
7,000,355 B2 * 2/2006 Flory ..... E06B 1/524 49/365
8,069,612 B2 * 12/2011 Lin ..... E05B 63/0017 49/365
8,069,613 B2 * 12/2011 Lin ..... E05B 65/104 49/365

(Continued)

OTHER PUBLICATIONS

Sargent ASSA ABLOY; Installation and Assembly Instructions for L980 Mullion; Copyright 2009, Sargent Manufacturing Company, an ASSA ABLOY Group company; 2 pages.

(Continued)

*Primary Examiner* — Chi Q Nguyen
(74) *Attorney, Agent, or Firm* — Taft Stettinius & Hollister LLP

(57) ABSTRACT

An exemplary fitting for a mullion includes a first bracket, a second bracket nested with the first bracket, and a lock cylinder assembly selectively coupling the first bracket and the second bracket. The nested brackets include a set of interleaved walls, and openings in the walls cooperate to define a pocket in which the lock cylinder assembly is seated. The lock cylinder assembly includes an armature having a first position and second position. When in the first position, the armature prevents removal of the lock cylinder assembly from the pocket such that the lock cylinder assembly prevents separation of the brackets. With the armature in the second position, the lock cylinder assembly can be removed from the pocket, after which the brackets can be separated from one another.

20 Claims, 7 Drawing Sheets

(56) References Cited

U.S. PATENT DOCUMENTS

| | | | | |
|---|---|---|---|---|
| 8,079,178 | B2 * | 12/2011 | Lin | E06B 1/524 49/365 |
| 8,082,695 | B2 * | 12/2011 | Lin | E06B 1/524 49/365 |
| 8,136,300 | B2 * | 3/2012 | Lin | E05B 63/242 292/219 |
| 9,982,476 | B2 * | 5/2018 | Clarke, Jr. | E06B 1/524 |
| 2004/0182009 | A1 * | 9/2004 | Flory | E06B 1/524 49/365 |
| 2011/0083368 | A1 * | 4/2011 | Lin | E05B 65/104 49/7 |
| 2012/0110913 | A1 * | 5/2012 | Greenfield | E06B 1/524 49/365 |

OTHER PUBLICATIONS

Hager Companies; 4900 Series Non-Keyed Removable Mullion Installation Instructions I-ED01037; 8 pages.

Detex; Installation Instructions for F9OKR & 90KR Keyed Removable Mullion (Top level pin & drawing: 100225); INS-F90KR; Oct. 12, 2010; 4 pages.

Corbin Russwin ASSAABLOY; Installation Instructions for 907BKM, 908BKM and 910KM Mullions; Copyright 2009 Corbin Russwin, Inc.; 2 pages.

* cited by examiner

KEYED REMOVABLE MULLION

TECHNICAL FIELD

The present disclosure generally relates to removable mullions, and more particular but not exclusively relates to such mullions for two-door doorways.

BACKGROUND

Mullions are vertical components that are frequently used in double door openings to separate the larger opening into two separate active openings. In certain circumstances, it is desired that the mullion be removable to enable the doorway to be used as a single larger opening, for example to accommodate the movement of large equipment through the doorway. Certain existing removable mullions are secured to the door using fasteners and/or a lock cylinder assembly, each of which may have limitations and/or drawbacks. For example, fasteners tend to become loose over time, do not prevent unauthorized persons from removing the mullion, and typically are more time-consuming to install and remove than keyed mullions. Certain mullions using lock cylinder assemblies can also be time-consuming to install and remove, and are typically more susceptible to vandal attacks that may damage the lock cylinder. For these reasons among others, there remains a need remains for further improvements in this technological field.

SUMMARY

An exemplary fitting for a mullion includes a first bracket, a second bracket nested with the first bracket, and a lock cylinder assembly selectively coupling the first bracket and the second bracket. The nested brackets include a set of interleaved walls, and openings in the walls cooperate to define a pocket in which the lock cylinder assembly is seated. The lock cylinder assembly includes an armature having a first position and second position. When in the first position, the armature prevents removal of the lock cylinder assembly from the pocket such that the lock cylinder assembly prevents separation of the brackets. With the armature in the second position, the lock cylinder assembly can be removed from the pocket, after which the brackets can be separated from one another. Further embodiments, forms, features, and aspects of the present application shall become apparent from the description and figures provided herewith.

DETAILED DESCRIPTION OF ILLUSTRATIVE EMBODIMENTS

Figure 2:
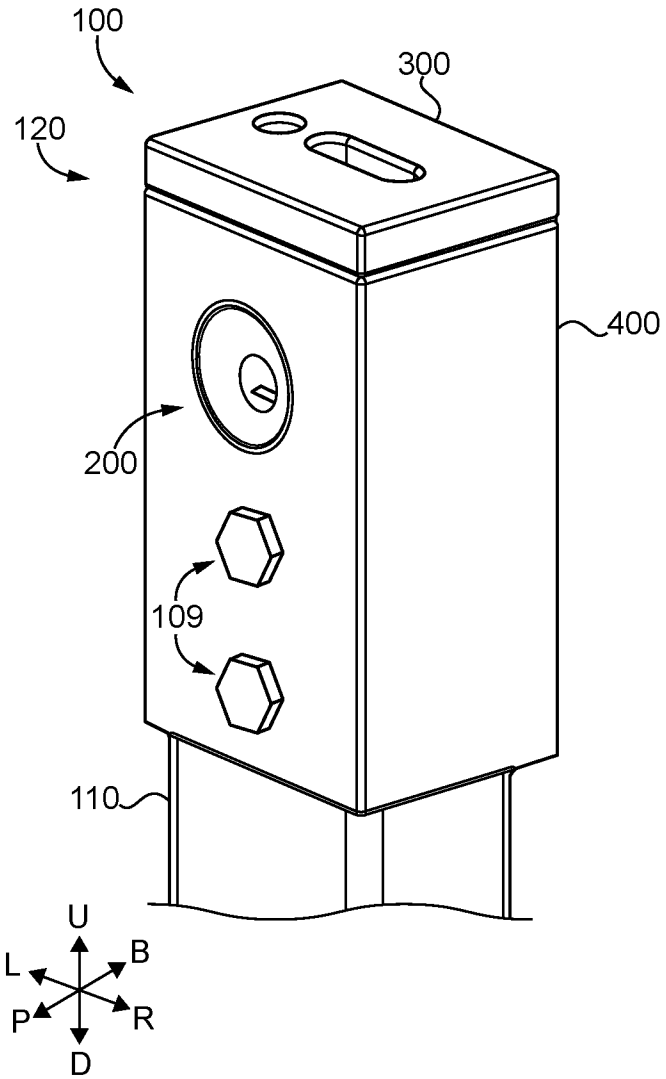
FIG. 2 is a perspective view of a mullion including a fitting according to certain embodiments, which fitting includes a lock cylinder assembly, a mounting bracket, and a housing bracket.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

Figure 1:
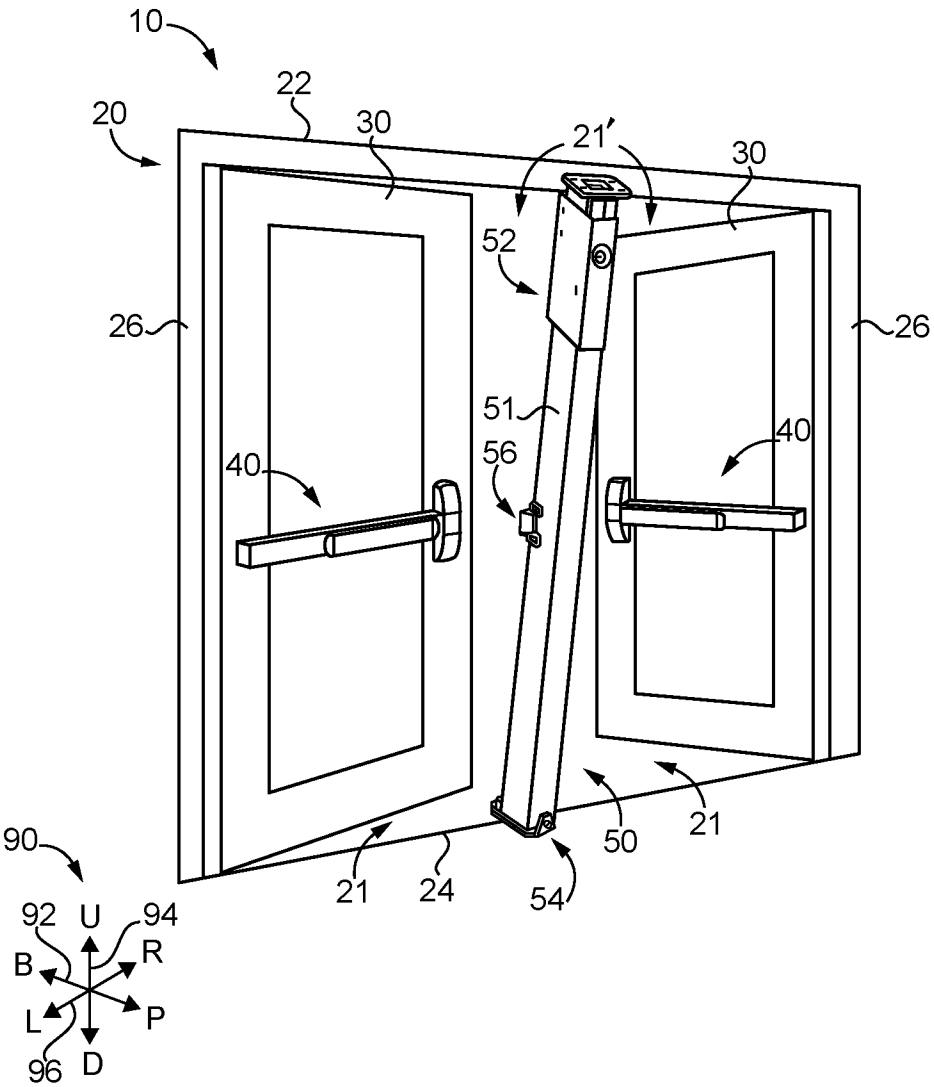
FIG. 1 is a perspective view of a closure assembly.

With reference to FIG. 1, illustrated therein is a closure assembly 10 that generally includes a frame 20 defining an opening 21, a pair of doors 30 pivotally mounted to the frame, and a pair of exit devices 40, each of which is mounted to a corresponding one of the doors 30. The frame 20 generally includes a head 22, a floor or sill 24, and a pair of hinge jambs 26 to which the doors 30 are pivotally mounted. The closure assembly 10 further includes a keyed removable mullion 50, which is illustrated as being installed to the frame 20. When installed, the mullion 50 divides the opening 21 into two distinct doorways 21'.

The mullion 50 generally includes a body portion 51, a head fitting 52 through which the body portion 51 is selectively coupled to the head 22, and a sill fitting 54 through which the body portion 51 is selectively coupled to the floor 24. Mounted to the body portion 51 are a pair of strikes 56, each of which is positioned to engage the latchbolt of a corresponding one of the exit devices 40.

Certain terms used herein are intended to denote motion or spacing along three mutually perpendicular axes, wherein each of the axes defines two opposite directions. For example, FIG. 1 illustrates a coordinate system 90 including a longitudinal X axis 92, a lateral Y axis 96, and a transverse Z axis 94, each of which axes defines first and second directions. Additionally, the descriptions that follow may refer to the directions defined by the axes with specific reference to a standardized orientation in which the mullion 50 is installed and is being viewed from key-receiving side thereof. Thus, the longitudinal X axis 92 may alternatively be referred to as the proximal/distal or forward/rearward axis 92, which defines a proximal or forward direction (F) extending toward the viewer and a distal or backward direction (B) extending away from the user. Similarly, the transverse Z axis 94 may be referred to as a vertical axis 94 that defines an upward direction (U) and a downward direction (D), and the lateral Y axis 96 may be referred to as a third axis 96 that defines a left direction (L) and a right direction (R). These terms are used for ease and convenience of description, and are therefore not to be construed as limiting the scope of the subject matter described herein. Furthermore, motion or spacing along a direction defined by one of the axes need not preclude motion or spacing along a direction defined by another of the axes. For example, elements which are described as being "laterally offset" from one another may also be offset in the longitudinal and/or transverse directions, or may be aligned in the longitudinal and/or transverse directions.

With additional reference to FIG. 2, illustrated therein is a mullion 100 including a mullion body 110 and a head fitting 120 according to certain embodiments. The illustrated mullion 100 is an embodiment of the mullion 50, such that the mullion body 110 and the head fitting 120 respectively correspond to the above-described mullion body 51 and head fitting 52. The mullion 100 may further include the sill fitting 54 and/or the strikes 56 illustrated in connection with the mullion 50.

The head fitting 120 generally includes a lock cylinder assembly 200, a mounting bracket 300 configured for mounting to the head 22, and a housing bracket 400 that is mounted to the mullion body 110 with a pair of fasteners 109. As described herein, the lock cylinder assembly 200 is mounted to the mounting bracket 300, is housed in the housing bracket 400, and selectively couples the mounting bracket 300 with the housing bracket 400.

Figure 3:
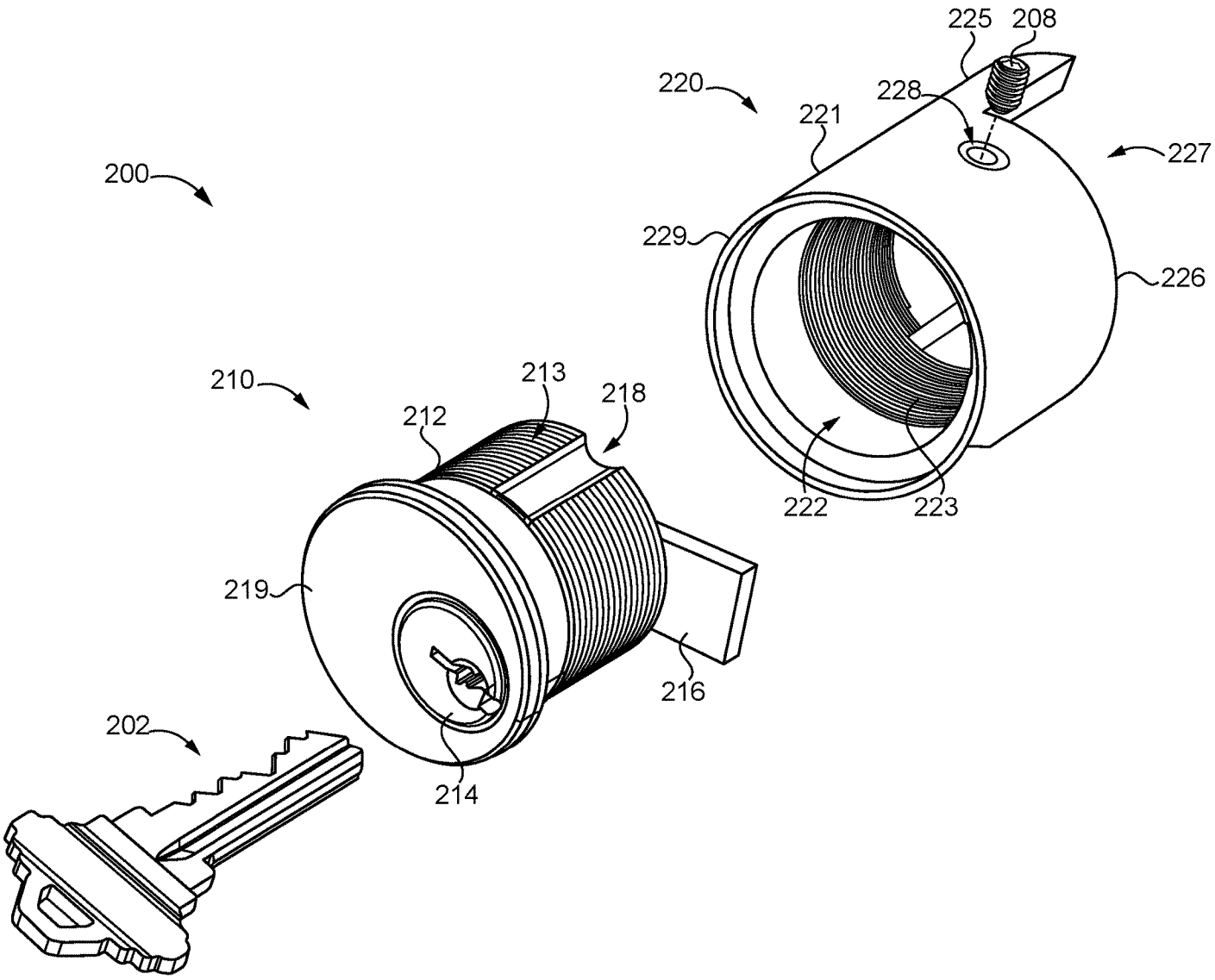
FIG. 3 is an exploded assembly view of the lock cylinder assembly.

With additional reference to FIG. 3, the lock cylinder assembly 200 generally includes a lock cylinder 210 operable by a key 202, and a casing 220 in which the lock cylinder 210 is housed. As is typical of lock cylinders, the lock cylinder 210 includes a shell 212, a plug 214 rotatably mounted in the shell 212, an armature 216 mounted to a distal end of the plug 214, and a tumbler system configured to selectively prevent rotation of the plug 214 relative to the shell 212 for joint rotation therewith. The tumbler system is also configured to permit rotation of the plug 214 relative to the shell 212 upon insertion of the proper key 202, thereby permitting authorized persons to selectively rotate the armature 216. The manner in which such lock cylinders operate is well known in the art, and need not be discussed in further detail herein. In the illustrated form, the shell 212 includes a set of external threads 213, and defines an external groove 218 that extends along the axial direction of the lock cylinder 210.

The casing 220 includes a proximal portion 221 defining a chamber 222 sized and shaped to house the lock cylinder 210, and in the illustrated embodiment includes a set of internal screw threads 223 that mate with the external screw threads 213 of the shell 212 to partially secure the lock cylinder to the casing 220. A distal portion 225 extends distally from one part of the proximal portion 221, while another part of the proximal portion 221 terminates in a rim 226. The casing 220 further includes a fixation aperture 228 that can be aligned with the groove 218 to facilitate insertion of a pin or a set screw 208. With the set screw 208 extending between the groove 218 and the aperture 228, the set screw 208 prevents rotation of the shell 212 within the chamber 222, and the engaged threads 213, 223 prevent relative movement of the lock cylinder 210 and the casing 220 in the axial directions thereof. Thus, the shell 212 and the casing 220 are axially and rotationally interlocked with one another.

The distal portion 225 has a geometry that facilitates rotational interlocking of the lock cylinder assembly 200 with the mounting bracket 300, and may alternatively be referred to as the rotational interlock portion 225. The distal portion 225 also partially defines an opening 227 that is further defined by the rim 226 of the proximal portion 221. With the lock cylinder 210 seated in the casing 220, rotation of the plug 214 causes the armature 216 to pivot into the opening 227 such that a portion of the armature 216 extends beyond the outer periphery of the rim 226.

In the illustrated form, the proximal portion 221 has a circular outer geometry, and the distal portion 225 has an arcuate geometry. It is also contemplated that the proximal portion 221 and/or the distal portion 225 may have other geometries. By way of example, the proximal portion 221 may have a rectangular outer geometry, and the rotational interlock portion 225 may have a geometry that includes fewer than all sides of the rectangle defining the geometry of the proximal portion 221. Alternatively, the rotational interlock portion 225 may have the same rectangular geometry as the proximal portion 221, and the opening 227 may be enclosed by a continuous perimeter partially defined by the rim 226.

Figure 10:
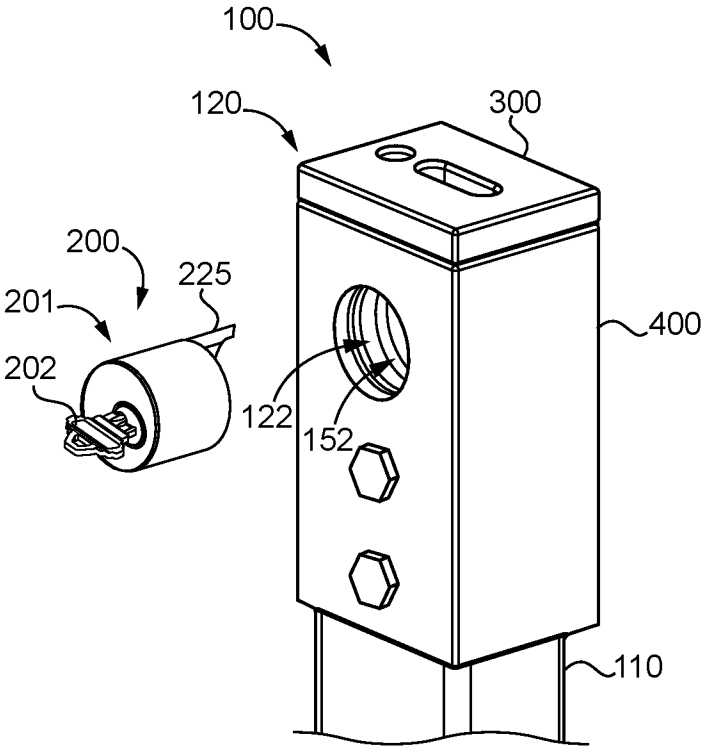
FIG. 10 illustrates the mullion during insertion of the lock cylinder assembly into a pocket defined by the housing bracket and the mounting bracket.
Figure 9:
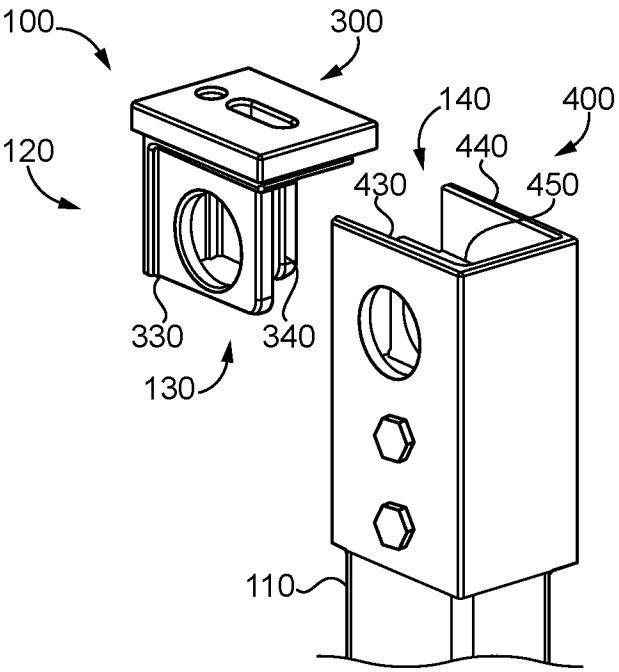
FIG. 9 illustrates the mullion during alignment of the housing bracket and the mounting bracket.
Figure 12:
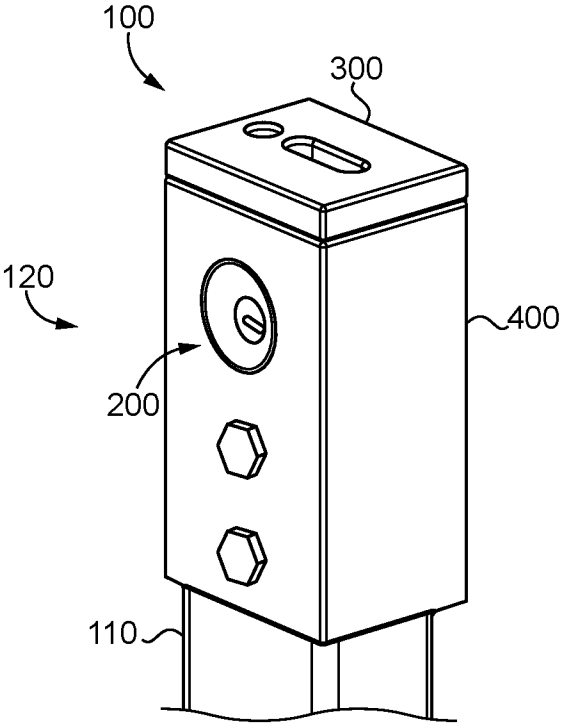
FIG. 12 is a perspective illustration of the assembled mullion.

During assembly, the lock cylinder 210 is first placed in an unlocked state by inserting the key 202 and rotating the plug 214, thereby placing the armature 216 in a pivoted position in which the armature 216 does not extend beyond the outer periphery of the shell 212. The lock cylinder 210 is then inserted into the chamber 222, and is rotated such that the threads 213, 223 mesh with one another and advance the lock cylinder 210 in the axial direction. When the lock cylinder 210 is fully seated in the casing 220, the set screw 208 is advanced into the groove 218 to rotationally interlock the shell 212 and the casing 220. As a result of this rotational interlocking, the threads 213, 223 prevent further relative axial movement of the lock cylinder 210 and the casing 220. The key 202 may then be rotated to return the plug 214 to its home position, thereby pivoting the armature 216 to a corresponding home position in which a portion of the armature 216 extends beyond the outer periphery of the rim 226. The key 202 may subsequently be removed to retain the lock cylinder assembly 200 in this state. When so assembled, the lock cylinder 210 and the proximal portion 221 of the casing 220 may be considered to define a proximal portion 201 (FIG. 10) of the lock cylinder assembly 200.

The mounting bracket 300 is configured to be mounted to the head 22 of the door frame 30, and generally includes an upper head plate 310 configured to abut the head 22, and three walls extending downward from the head plate 310. More specifically, extending from the head plate 310 are a side wall 320, a proximal wall 330, and a distal wall 340. The proximal wall 330 and the distal wall 340 are offset from one another such that a gap 305 is formed therebetween, and each of the proximal wall 330 and the distal wall 340 is connected to and extend from the side wall 320. In the standard orientation described above, the proximal wall 330 and the distal wall 340 define faces that face the user. As such, the proximal wall 330 and the distal wall 340 may alternatively be referred to herein as first face walls 130 of the mullion 100.

Figure 5:
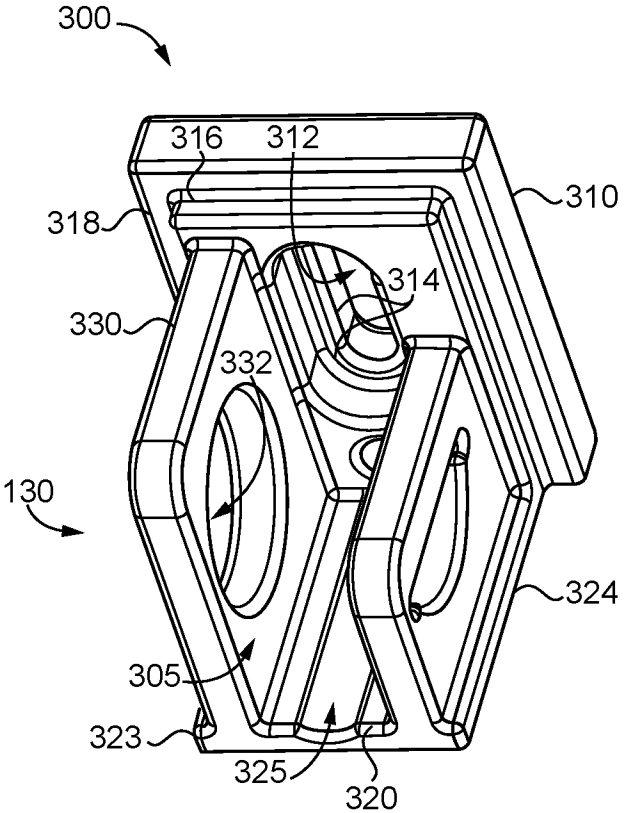
FIGS. 4 and 5 are perspective views of the mounting bracket.
Figure 4:
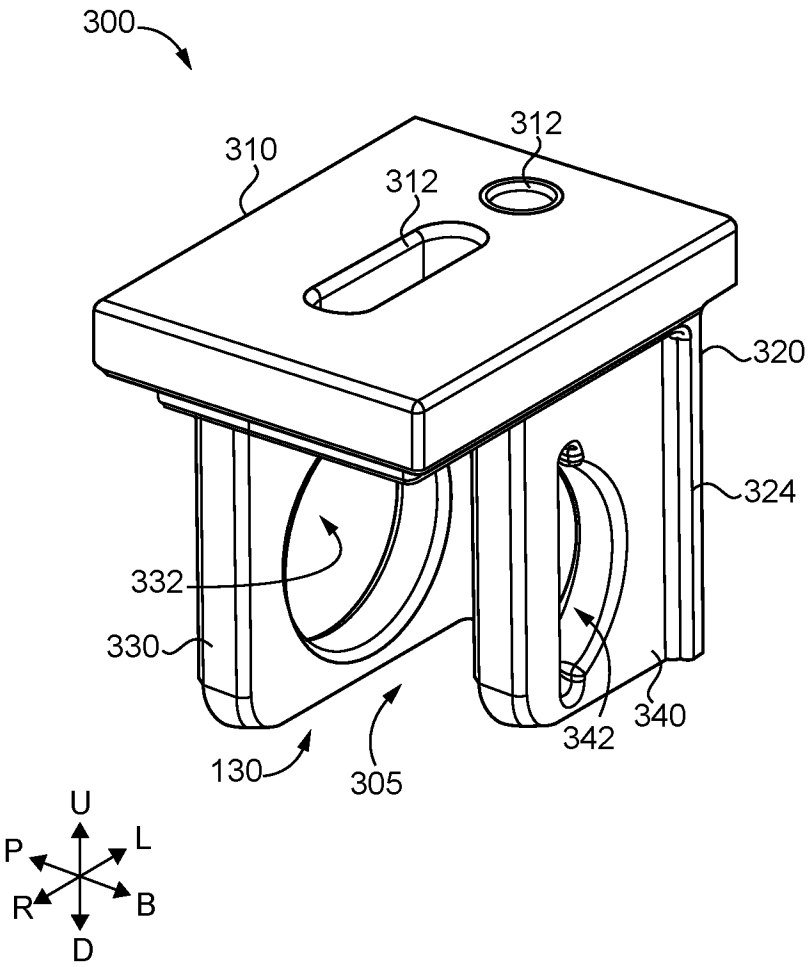

The head plate 310 includes one or more mounting apertures 312 that facilitate the attachment of the mounting bracket 300 to the head 22. The head 22 may have a set of mounting apertures configured to receive bolts, and the mounting apertures 312 may be sized and spaced to align with the apertures in the head. In the illustrated embodiment, one of the mounting apertures 312 is elongated to accommodate potential variances in the spacing of the apertures formed in the head. As illustrated in FIG. 5, the head plate 310 may include one or more steps 314 adjacent the mounting apertures 312, such that the mounting apertures 312 are stepped to accommodate bolts having heads of different sizes. The head plate 310 also includes a peninsular plateau 316 that is surrounded on three sides by a lip 318, and which is connected on the remaining side to the side wall 320.

The side wall 320 extends downward from the head plate 310, and partially delimits the space 350 between the proximal and distal walls 330, 340. The proximal and distal walls 330, 340 extend rightward from the side wall, and a ridge is formed adjacent the locations the walls meet. More specifically, a proximal lip 323 extends proximally of the proximal wall 330, and a distal lip 324 extends distally of the distal wall 340. The right or inner side of the side wall 320 may include a groove 325 that facilitates insertion of a bolt into the smaller of the mounting apertures 312.

The proximal wall 330 includes a receiving opening 332 sized and shaped to receive the lock cylinder assembly 200. In the illustrated embodiment, the receiving opening 332 is circular to accommodate the circular outer geometry of the casing 220. It is also contemplated that the receiving opening 332 may have another geometry, for example in embodiments in which the outer geometry of the casing 220 is non-circular.

The distal wall 340 includes an anti-rotation opening 342 that is sized and shaped to receive the rotational interlock portion 225 while preventing rotation of the casing 220 relative to the mounting bracket 300. In the illustrated form, the geometry of the anti-rotation opening 342 is that of a circular segment corresponding to the arcuate geometry of the rotational interlock portion 225. As will be appreciated, it is also contemplated that the anti-rotation opening 342 may have another geometry, for example in embodiments in which the rotational interlock portion 225 is non-arcuate.

Figure 6:
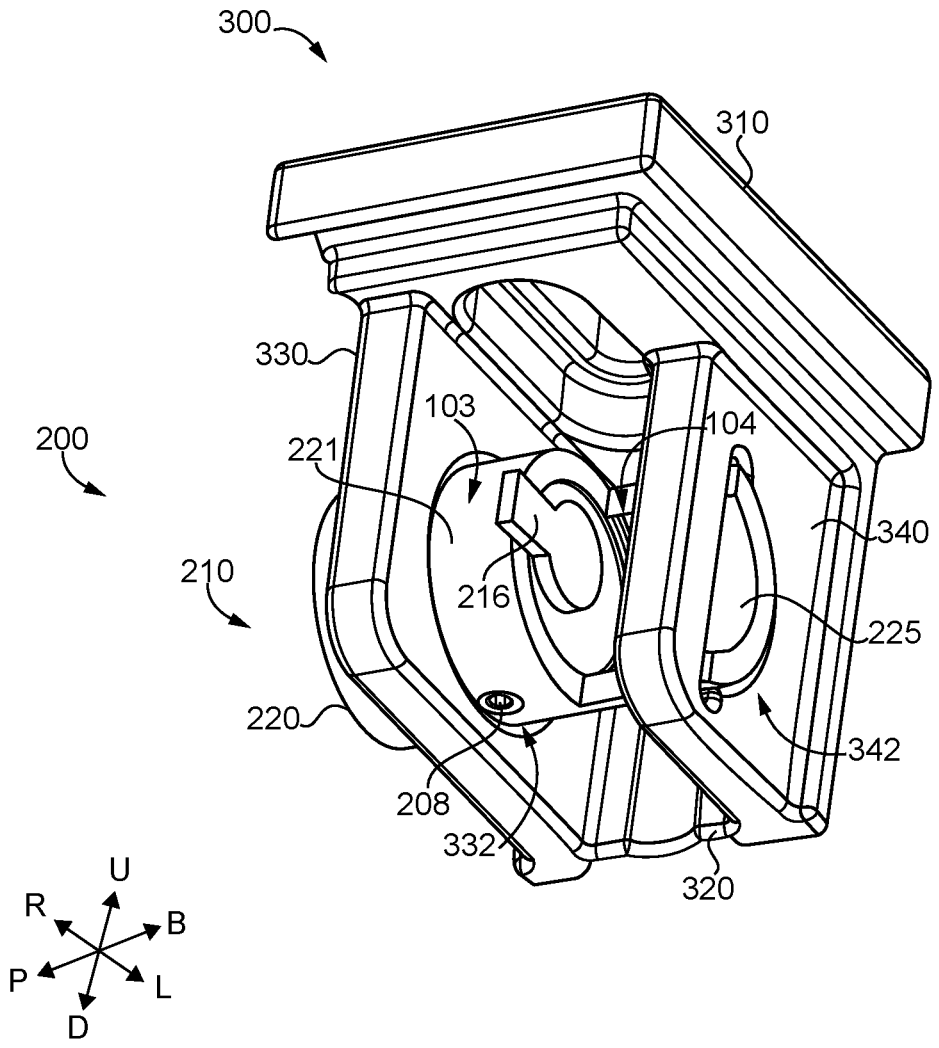
FIG. 6 is a perspective view of the lock cylinder assembly and the mounting bracket assembled to one another.

FIG. 6 illustrates the lock cylinder assembly 200 installed to the mounting bracket 300. In this state, the lock cylinder assembly 200 is seated in the mounting bracket such that the proximal portion 221 is received in the receiving opening 232 and the distal portion 225 is received in the anti-rotation opening 242. With the armature 216 in its home position, a proximal gap 103 is formed between the armature 216 and the proximal wall 330 and a distal gap 104 is formed between the armature 216 and the distal wall 340. Thus, the various features of the lock cylinder assembly 200 and the mounting bracket 300 aid in constraining the lock cylinder assembly 200 and the mounting bracket to relative movement in the proximal and distal directions, and the extent to which such movement is permitted corresponds to the dimensions of the gaps 103, 104.

Figure 8:
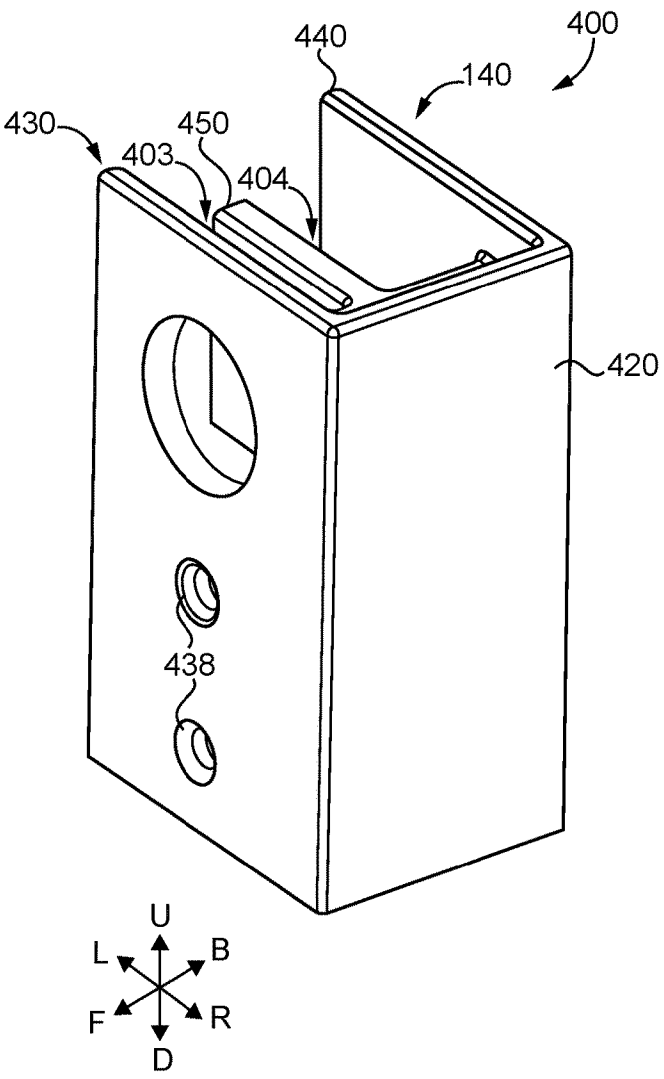
FIGS. 7 and 8 are perspective views of the housing bracket.
Figure 7:
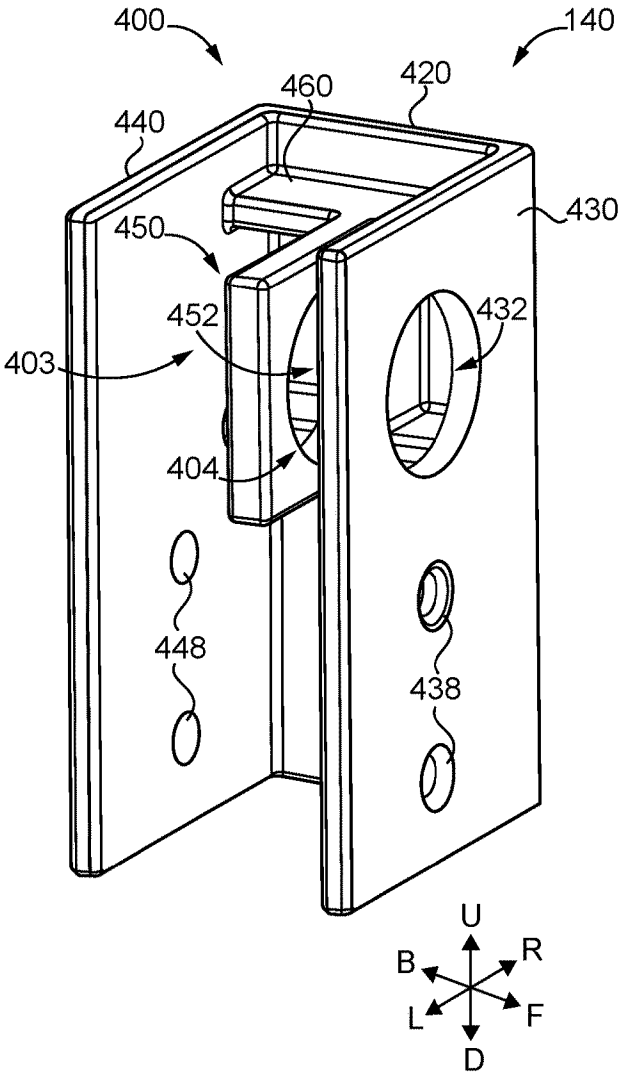

With additional reference to FIGS. 7 and 8, the housing bracket 400 generally includes a side wall 420, a proximal wall 430, a distal wall 440, and an intermediate wall 450. Each of the proximal wall 430, the distal wall 440, and the intermediate wall 450 extends from the side wall 420 in the leftward direction. The intermediate wall 450 is positioned between the proximal wall 430 and the distal wall 440 such that gaps are formed therebetween. More specifically, a proximal gap 403 is formed between the intermediate wall 450 and the proximal wall 430, and a distal gap 404 is formed between the intermediate wall 450 and the distal wall 440. The housing bracket 400 may further include a support ledge 460 that extends between the proximal wall 430 and the distal wall 440 and which is connected to the intermediate wall 450. In the standard orientation described above, the proximal wall 430, the distal wall 440, and the intermediate wall 450 define faces that face the user. As such, the proximal wall 430, the distal wall 440, and the intermediate wall 450 may alternatively be referred to herein as second face walls 140 of the mullion 100.

The proximal wall 430 includes a proximal receiving opening 432, and the intermediate wall 450 includes an intermediate receiving opening 452. Each of the receiving openings 432, 452 is configured for alignment with the mounting bracket receiving opening 332, and is sized and shaped to receive the proximal portion 221 of the casing 220. The proximal wall 430 further includes a first pair of mounting apertures 438, and the distal wall 440 includes a second pair of mounting apertures 448 aligned with the first pair of mounting apertures 438. In the illustrated form, the intermediate wall 450 is shorter than the proximal wall 430 and the distal wall 440 such that the intermediate wall 450 does not interfere with the alignment of the mounting apertures 438, 448.

Installation of the mullion 100 may begin with an initial set-up phase, in which the sill fitting 54 is secured to the sill 24, and the mounting bracket 300 is secured to the head 22 directly above the sill fitting 54. By way of example, the mounting bracket 300 may be secured to the head 22 by passing bolts through the mounting apertures 312 and a corresponding pair of apertures in the head 22, and engaging the bolts with a pair of threaded openings formed by or positioned within the head 22. The initial set-up phase may further include cutting the mullion body 110 to the appropriate length, and securing the housing bracket 400 to the top end portion of the mullion body 110.

Securing the housing bracket 400 to the mullion body 110 generally includes seating the housing bracket 400 on the top end portion of the mullion body 110 such that the side wall 420 is positioned on one side (in the illustrated embodiment, the right side) of the mullion body 110, the proximal wall 430 is positioned in front of the proximal face of the mullion body 110, the distal wall 440 is positioned behind the distal face of the mullion body 110, and the top end of the mullion body 110 abuts the bottom end of the intermediate wall 450, thereby supporting the housing bracket 400. From this position, the housing bracket 400 can be secured to the mullion body 110 with fasteners that pass through the mounting apertures 438, 448. For example, female sex bolts may be passed through one pair of mounting apertures 438/448, male sex bolts may be passed through the other pair of mounting apertures 438/448, and the sex bolts may be threadedly engaged with one another within the mullion body 110.

With additional reference to FIGS. 9-12, the process of removably installing the mullion 100 to the prepared closure assembly may proceed after the initial set-up phase has been completed. In the interest of more clearly illustrating the components of the mullion 100, the frame 20 and the bolts by which the mounting bracket are mounted to the frame 20 are omitted from the illustrations of FIGS. 9-12. In certain embodiments, the process may begin by attaching the bottom end portion of the mullion body 110 to the sill fitting 54, for example in embodiments in which the sill fitting 54 provides a pivotal mounting point for the mullion body 110. It is also contemplated that the lower end portion of the mullion body 110 may be attached to the sill fitting at a later point in the installation process. For example, the sill fitting 54 may take the form of the illustrated head fitting 120, and certain portions of the following process may be repeated or altered to accommodate such a configuration.

Figure 11:
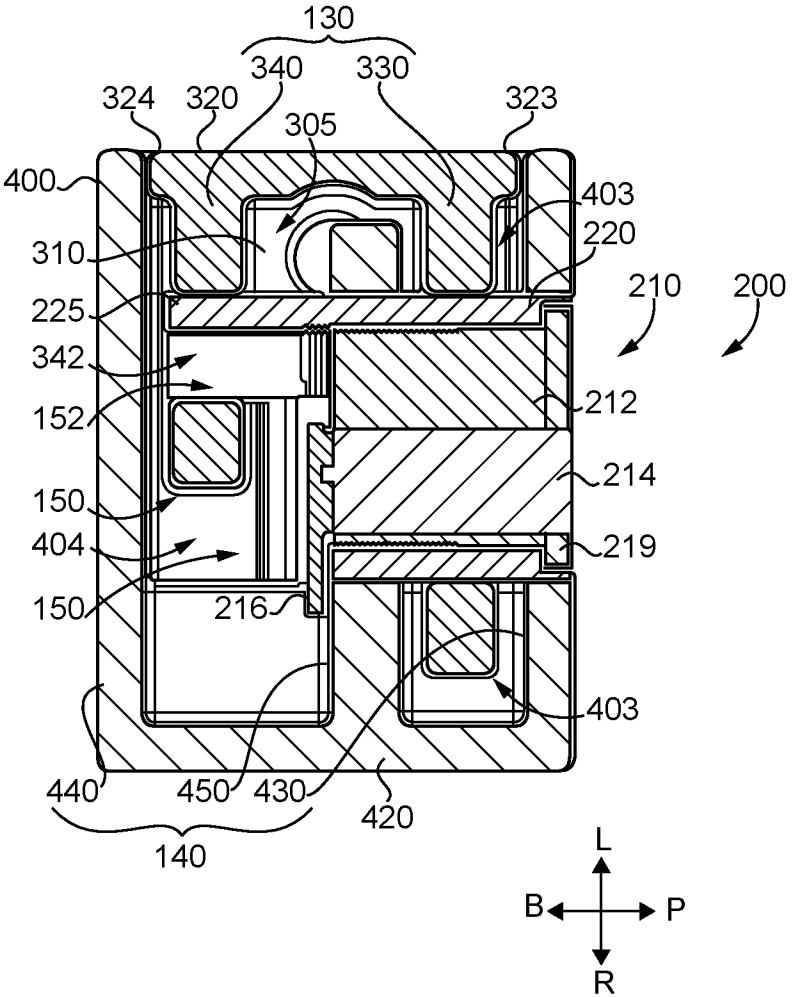
FIG. 11 is a cross-sectional illustration of the assembled fitting.

The installation process involves aligning the mounting bracket 300 with the housing bracket 400 (FIG. 9) such that the first face walls 130 (i.e., the walls 330, 340 of the mounting bracket 300) are generally parallel with the second face walls 140 (i.e., the walls 430, 440, 450 of the housing bracket 400). When so aligned, the mounting bracket 300 and the housing bracket 400 are meshed with one another such that the first face walls 130 are interleaved with the second face walls 140, thereby forming a set of interleaved walls 150 (FIG. 11). When so interleaved, the receiving openings 332, 432, 452 are aligned with one another and form a collective receiving opening 122. The collective receiving opening 122 and the anti-rotation opening 342 cooperate to define a pocket 152 of the interleaved walls, which pocket 152 is operable to receive the lock cylinder assembly 200.

With the mounting bracket 300 and the housing bracket 400 engaged with one another (FIG. 10), relative movement of the mounting bracket 300 and the housing bracket 400 is constrained by various components of the head fitting 120. For example, the lip 318 of the top plate 310 is positioned adjacent the top end of the housing bracket 400 such that the plateau 316 is received between the proximal and distal walls 430, 440 of the housing bracket 400 and is adjacent the housing bracket side wall 420. Relative movement along the proximal/distal axis 92 is further constrained by engagement of the proximal and distal walls 430, 440 of the housing bracket 400 with the mounting bracket side wall 320. Of note, the lips 323, 324 provide for this engagement while maintaining clearance between the proximal walls 330, 430 and maintaining clearance between the distal walls 340, 440, which clearances may facilitate the insertion of the mounting bracket 300 into the housing bracket 400.

With the mounting bracket 300 received in the housing bracket 400 (FIG. 10), the lock cylinder assembly 200 may be installed to releasably secure the mounting bracket 300 and the housing bracket 400 to one another. In order to do so, the key 202 is inserted to the lock cylinder 210 and the plug 214 is rotated, thereby pivoting the armature 216 from its home position to its pivoted position. When in its pivoted position, the armature 216 does not interfere with insertion of the lock cylinder assembly 200 to the collective receiving opening 122. As the lock cylinder assembly 200 is inserted into the pocket 152, the distal portion 225 of the casing 220 enters the anti-rotation opening 342, thereby rotationally interlocking the casing 220 and the mounting bracket 300. In the illustrated form, the anti-rotation opening 342 is asymmetrical about the axis along which the lock cylinder assembly 200 is inserted, such that the lock cylinder assembly 200 can only be seated in the collective opening at the proper orientation. As a result, the anti-rotation opening 342 cooperates with the rotational interlock portion 225 to prevent the lock cylinder assembly 200 from being seated in the pocket 152 in improper orientations relative to the interleaved walls 150.

With the lock cylinder assembly 200 seated in the pocket 152 defined by the interleaved walls 150 (FIG. 11), the key 202 may be rotated to return the plug 214 to its home position and the key 202 may be removed. Such rotation of the plug 214 pivots the armature 216 to its home position, thereby causing a portion of the armature to extend beyond the outer periphery of the casing 220 and the inner periphery of the collective receiving opening 122. As a result, the intermediate wall 450 is captured between the armature 216 and the proximal wall 330 of the mounting bracket 300, and prevents the lock cylinder assembly 200 from being withdrawn from the pocket 152. Relative movement of the mounting bracket 300 and the housing bracket 400 along the proximal/distal axis 92 is also constrained by engagement of the proximal and distal walls 430, 440 with the lips 323, 324 and/or the plateau 316.

When the key 202 is removed from the lock cylinder 210 (FIG. 12), the mullion 100 is removably installed to the closure assembly 10. When it is subsequently desired to remove the mullion 100, the key 202 may be inserted and rotated to pivot the armature 216 from its home position to its pivoted position. With the armature 216 in its pivoted position, the lock cylinder assembly 200 can be removed from the interleaved walls 150, after which the mullion 100 may be moved to separate the first face walls 130 from the second face walls 140. With the housing bracket 400 separated from the mounting bracket 300, removal of the mullion 100 is facilitated.

As is evident from the foregoing, removal of the mullion 100 requires the use of a proper key 202, which discourages vandalism by preventing the mullion 100 from being removed by unauthorized persons. The mullion 100 also exhibits additional features that may provide for vandal-resistant characteristics. For example, one method of attack on mullions involves kicking or otherwise impacting the mullion body, which can tend to damage the lock cylinders of certain existing keyed mullions. In the present mullion 100, however, these loads are borne by the casing 220 that surrounds the lock cylinder 210. Thus, mechanical shock loads are transmitted from the housing bracket face walls 140 to the mounting bracket face walls 130 via the casing 220, which shields the lock cylinder 210 from impacts that may otherwise damage the internal components thereof. Given the tight tolerances typically required by lock cylinders, the load-bearing characteristics of the casing 220 may prevent damage that would otherwise render the lock cylinder 210 inoperable.

Another method of vandalizing keyed mullions is to attempt to remove or otherwise tamper with the lock cylinder thereof. In the illustrated embodiment, various features of the head fitting discourage or prevent such tampering. For example, the face plate 219 of the lock cylinder 210 is surrounded by a lip 229, which discourages the insertion of a lever between the face plate and the rim 224, as may be attempted by a vandal attempting to pry the lock cylinder 210 away from the casing 220. Additionally, in order to unscrew the shell 212 from the casing 220, the fastener 208 must first be retracted out of the groove 218. When the head fitting 120 is assembled and interlocked, however, access to the fastener 208 is prevented, as is evident from FIG. 6. As such, the lock cylinder 210 can only be separated from the casing 220 by first removing the lock cylinder assembly 200 from the pocket 152, which removal requires the use of the key 202.

Certain features of the head fitting 120 may also facilitate the processes of installing and removing the mullion 100. For example, certain existing removable mullions require that fasteners such as bolts be attached and removed during the installation and removal of the mullion. By contrast, the lock cylinder assembly 200 of the illustrated mullion 100 is capable of interlocking the mounting bracket 300 and the housing bracket 400 without requiring the use of additional fasteners. Accordingly, the additional step of installing or removing such fasteners may be omitted.

In the embodiments described and illustrated herein, the mounting bracket 300 includes two face walls 130 (i.e., the proximal wall 330 and the distal wall 340), and the housing bracket 400 includes three face walls 140 (i.e., the proximal wall 430, the distal wall 440, and the intermediate wall 450). In other embodiments, these features may be reversed such that the mounting bracket 300 includes three face walls with features analogous to those of the illustrated face walls 140 and the housing bracket 400 includes two face walls with features analogous to those of the illustrated face walls 130. In addition or in the alternative, one or both of the brackets 300, 400 may include additional face walls such that the set of interleaved walls 150 includes more than five interleaved walls 150. In such forms, the pocket 152 may extend through more than four of the interleaved walls 150.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A head fitting for a removable mullion, the head fitting comprising:

a first bracket comprising:

a first side wall, wherein the first side wall has a first side wall length along a first axis, a first side wall width along a second axis, and a first side wall thickness along a third axis, wherein the third axis defines a first direction and an opposite second direction, and wherein the first axis, the second axis, and the third axis are mutually orthogonal;

a first proximal wall extending from the first side wall in the first direction, wherein the first proximal wall has a first proximal wall receiving opening; and a first distal wall extending from the first side wall in the first direction, wherein the first distal wall has an anti-rotation opening;

wherein the first proximal wall and the first distal wall are offset from one another along the second axis such that a first gap is formed therebetween;

a second bracket comprising:

a second side wall, wherein the second side wall has a second side wall length along the first axis, a second side wall width along the second axis, and a second side wall thickness along the third axis;

a second proximal wall extending from the second side wall in the second direction, the second proximal wall including a second proximal wall receiving opening;

a second distal wall extending from the second side wall in the second direction; and an intermediate wall extending from the second side wall in the second direction, the intermediate wall including an intermediate wall receiving opening;

wherein the intermediate wall is received in the first gap;

wherein the second proximal wall and the intermediate wall are offset from one another along the second axis such that a second gap is formed therebetween, and wherein the first proximal wall is received in the second gap such that the first proximal wall receiving opening, the second proximal wall receiving opening, and the intermediate wall receiving opening are aligned with one another and form a collective receiving opening; and wherein the second distal wall and the intermediate wall are offset from one another along the second axis such that a third gap is formed therebetween, and wherein the first distal wall is received in the third gap such that the anti-rotation opening is aligned with the collective receiving opening; and a lock cylinder assembly comprising:

a lock cylinder comprising a shell, a plug rotatably mounted in the shell, and an armature coupled to a distal end of the plug, wherein the plug is operable to rotate relative to the shell upon insertion of a proper key, and wherein the armature is configured to rotate with the plug between a home position and a pivoted position; and a casing defining a chamber in which the lock cylinder is seated, the casing including a proximal portion received in the collective receiving opening and a second portion received in and rotationally interlocked with the anti-rotation opening;

wherein one of the first bracket or the second bracket further includes a top plate having at least one aperture for receiving a mounting fastener, and wherein the walls of the one of the first bracket or the second bracket extend downward from the top plate;

wherein, for another of the first bracket or the second bracket, the proximal wall includes a first mounting aperture formed below the receiving opening thereof, and the distal wall includes a second mounting aperture aligned with the first mounting aperture;

wherein, with the armature in the home position, the armature extends beyond an outer periphery of the casing and an inner periphery of the collective receiving opening, thereby preventing the lock cylinder assembly from moving along the second axis relative to the first bracket and the second bracket; and wherein, with the armature in the pivoted position, the armature is positioned within the outer periphery of the casing, and the lock cylinder assembly is capable of moving along the second axis relative to the first bracket and the second bracket.

2. The head fitting of claim 1, wherein the casing includes an aperture, and wherein a fastener extends through the aperture and engages the shell, thereby preventing relative movement between the casing and the shell.

3. The head fitting of claim 2, wherein the shell and the casing include screw threads that are meshed with one another.

4. The head fitting of claim 1, wherein the first bracket comprises the top plate, wherein the top plate includes a plateau extending from the first side wall in the first direction, and an upper lip partially surrounding the plateau, wherein the plateau abuts an upper surface of the intermediate wall, and wherein the upper lip abuts upper surfaces of the second side wall, the second proximal wall, and the second distal wall.

5. The head fitting of claim 4, wherein the first side wall defines a proximal lip extending proximally of the first proximal wall and a distal lip extending distally of the first distal wall, wherein the first side wall is captured between the second proximal wall and the second distal wall, wherein the second proximal wall abuts the proximal lip, and wherein the second distal wall abuts the distal lip.

6. A removable mullion comprising the head fitting of claim 1, the mullion further comprising a mullion body, wherein a top end portion of the mullion body is secured to the other of the first bracket or the second bracket by a first fastener that extends through the first mounting aperture.

7. The removable mullion of claim 6, further comprising a sill fitting and a pair of strikes, wherein the sill fitting is configured for attachment to a sill of a door frame, wherein a bottom end portion of the mullion body is releasably secured to the sill fitting, and wherein the strikes are mounted to an intermediate portion of the mullion body.

8. A closure assembly including the mullion of claim 7, the closure assembly further comprising a door frame having a head, a sill opposite the head, and a pair of hinge jambs extending between and connecting the head and the sill, wherein the one of the first bracket or the second bracket is secured to the head via a second fastener that extends through the at least one aperture, and wherein the sill fitting is secured to the sill.

9. A fitting for a removable mullion, the fitting comprising:

a first bracket including a first sidewall and a first plurality of face walls, wherein the first plurality of face walls extend from the first side wall in a first direction, and wherein the first plurality of face walls are offset from one another along an axis;

a second bracket including a second sidewall and a second plurality of face walls, wherein the second plurality of face walls extend from the second side wall in a second direction opposite the first direction, and wherein the second plurality of face walls are offset from one another along the axis; and a lock cylinder assembly comprising:

a lock cylinder comprising a shell, a plug rotatably mounted in the shell, and an armature coupled to a distal end of the plug, wherein the plug is operable to rotate relative to the shell upon insertion of a proper key; and a casing defining a chamber in which the lock cylinder is seated, the casing including a rotational interlock portion and a casing opening operable to receive at least a portion of the armature;

wherein the armature is configured to rotate with the plug between a home position in which the armature extends through the casing opening and projects beyond an outer periphery of the casing, and a pivoted position in which the armature is positioned within the outer periphery of the casing;

wherein the first plurality of face walls and the second plurality of face walls are interleaved with one another and define a set of interleaved walls, wherein the interleaved walls are positioned between the first side wall and the second side wall, wherein the set of interleaved walls includes a first interleaved wall and a second interleaved wall, wherein the first interleaved wall is a face wall of the first plurality of face walls, and wherein the second interleaved wall is a face wall of the second plurality of face walls and is adjacent the first interleaved wall;

wherein the set of interleaved walls define a pocket including a receiving opening and an anti-rotation opening;

wherein the anti-rotation opening extends through at least a portion of at least one interleaved wall of the set of interleaved walls, and wherein the rotational interlock portion of the casing is received in the anti-rotation opening such that the casing is rotationally interlocked with the at least one interleaved wall;

wherein the set of interleaved walls further define a receiving opening that extends through at least the first interleaved wall and the second interleaved wall, and wherein the casing is seated in the receiving opening such that the casing interlocks the first interleaved wall and the second interleaved wall for joint movement in directions transverse to the axis;

wherein with the armature in the home position, the second interleaved wall is captured between the armature and the first interleaved wall, and the armature is configured to engage the second interleaved wall to retain the lock cylinder assembly in the receiving opening;

wherein with the armature in the pivoted position, the armature is positioned within the outer periphery of the casing, and the lock cylinder assembly is capable of being moved along the axis to remove the lock cylinder assembly from the receiving opening;

wherein one of the first bracket or the second bracket further includes a plate having a mounting arrangement, the mounting arrangement including at least one aperture for receiving a mounting fastener, and wherein the walls of the one of the first bracket or the second bracket extend from the plate; and wherein, for another of the first bracket or the second bracket, one of the face walls includes a first mounting aperture positioned below the receiving opening.

10. The fitting of claim 9, wherein for the another of the first bracket or the second bracket, another of the face walls includes a second mounting aperture aligned with the first mounting aperture along the axis.

11. The fitting of claim 9, wherein the shell includes a set of external screw threads, and wherein the casing includes a set of internal screw threads engaged with the internal screw threads.

12. The fitting of claim 11, wherein the shell further comprises an external groove, wherein the casing further comprises an opening aligned with the groove, and wherein a fastener extends between the groove and the opening, thereby preventing relative rotation of the shell and the casing.

13. The fitting of claim 9, wherein the casing has a proximal portion and a distal portion, wherein the proximal portion has a circular cross-section, wherein the distal portion comprises the rotational interlock portion, and wherein the rotational interlock portion has an arcuate cross-section.

14. The fitting of claim 9, wherein the anti-rotation opening is configured to receive the rotational interlock portion only when the casing has a particular orientation relative to the at least one interleaved wall, thereby preventing the lock cylinder assembly from being seated in the pocket in improper orientations relative to the interleaved walls.

15. The fitting of claim 9, wherein the first plurality of face walls includes a first proximal wall and a first distal wall;

wherein the second plurality of face walls includes a second proximal wall, a second distal wall, and an intermediate wall positioned between the second proximal wall and the second distal wall;

wherein the anti-rotation opening is formed in the first distal wall; and wherein the receiving opening extends through the first proximal wall, the second proximal wall, and the intermediate wall.

16. The fitting of claim 15, wherein the first proximal wall is positioned between and adjacent the second proximal wall and the intermediate wall, and wherein the first distal wall is positioned between and adjacent the second distal wall and the intermediate wall.

17. The fitting of claim 9, wherein the casing bears loads in the directions transverse to the proximal/distal axis without transmitting said loads to the lock cylinder.

18. The fitting of claim 9, wherein the anti-rotation opening is distinct from the receiving opening.

19. The fitting of claim 18, wherein the anti-rotation opening has a different geometry in comparison to the receiving opening.

20. The fitting of claim 9, wherein the first bracket is secured to the second bracket entirely by the lock cylinder assembly.

* * * * *